US005304758A

United States Patent [19]

Bishop et al.

[11] Patent Number: 5,304,758

[45] Date of Patent: Apr. 19, 1994

[54] TEMPERATURE COMPENSATED LOW PRESSURE SWITCH FOR HYBRID INFLATORS

[75] Inventors: Robert J. Bishop, Mt. Clemens; Richard L. Frantom, Richmond; Robert M. Kremer; Klaus F. Ocker, both of Fraser, all of Mich.; Roy G. Brown, Hot Springs, Ark.; Teresa L. Bazel, Annadale, Va.; Donald W. Renfroe, Haymarket, Va.

[73] Assignee: Bendix Atlantic Inflator Company, Sterling Heights, Mich.

[21] Appl. No.: 876,241

[22] Filed: Apr. 30, 1992

[51] Int. Cl.[5] ..... H01H 35/34

[52] U.S. Cl. ..... 200/83 J; 200/83 R

[58] Field of Search ..... 200/83 R, 83 A, 83 B, 200/83 J, 83 P, 83 W

[56] References Cited

U.S. PATENT DOCUMENTS

| | | | |
|---|---|---|---|
| 3,816,685 | 6/1974 | Fiore | 200/83 S |
| 4,495,389 | 1/1985 | Place | 200/83 P |
| 5,049,708 | 9/1991 | Baker | 200/83 P |

*Primary Examiner*—A. D. Pellinen
*Assistant Examiner*—Michael Friedhofer
*Attorney, Agent, or Firm*—Markell Seitzman

[57] ABSTRACT

A pressure switch (30) adapted to be placed within a pressurized chamber for generating a logical signal when the pressure within the chamber reduces to a determinable pressure $P_1$. The pressure switch (30) comprises: a pressure vessel (32) sealed at one end (34) by a snap action diagram (40) and having an inner stop (42) and an outer stop (60, 62) respectively positioned on opposing sides of the diaphragm (40) for limiting diaphragm motion. The outer stop comprises: a first cylindrical portion (78), a first pair of parallel slots (80*a, b*) formed therein and a through bore (70, 72, 74) extending therethrough. A switch assembly is loosely mounted to the outer stop. The switch assembly (90) comprises an upper housing member (92), a lower housing member (94), first and second electrical contacts (96*a*, 96*b*) and a pin (98). The upper housing member (92) comprising a hollow cylindrical portion (100) adapted to be slid over first cylindrical portion including a second pair of opposing slots (113*a, b*), the first and second cylindrical portions (78, 100) are loosely secured together by a clip (150) fitted within the first and second pair of slots (80*a,b*; 112*a,b*) to eliminate compressive loading between the switch assembly and other components of the switch.

5 Claims, 3 Drawing Sheets

FIG.1 (PRIOR ART)
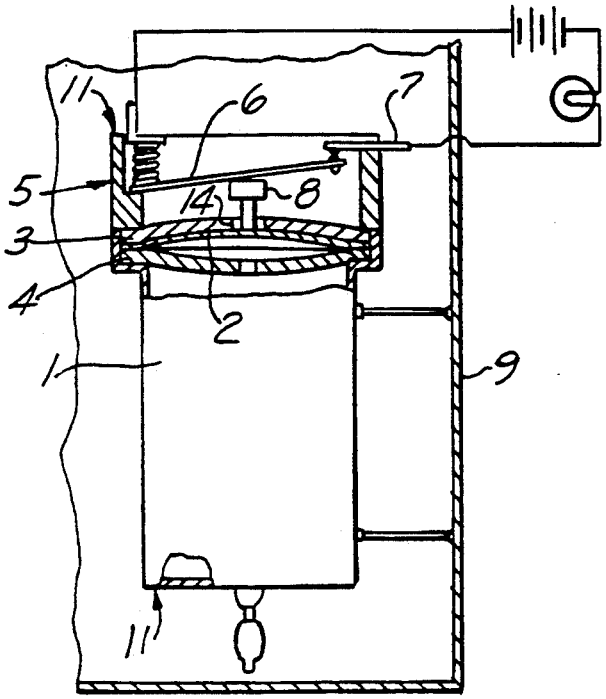
FIG.2 (PRIOR ART)
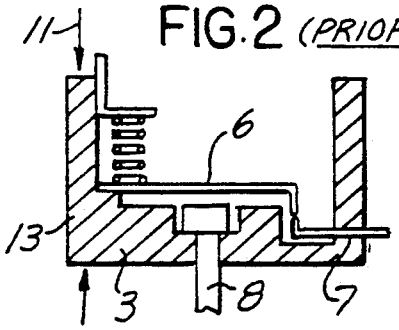
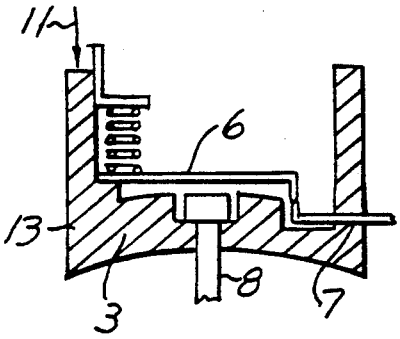
FIG.3 (PRIOR ART)
FIG.4
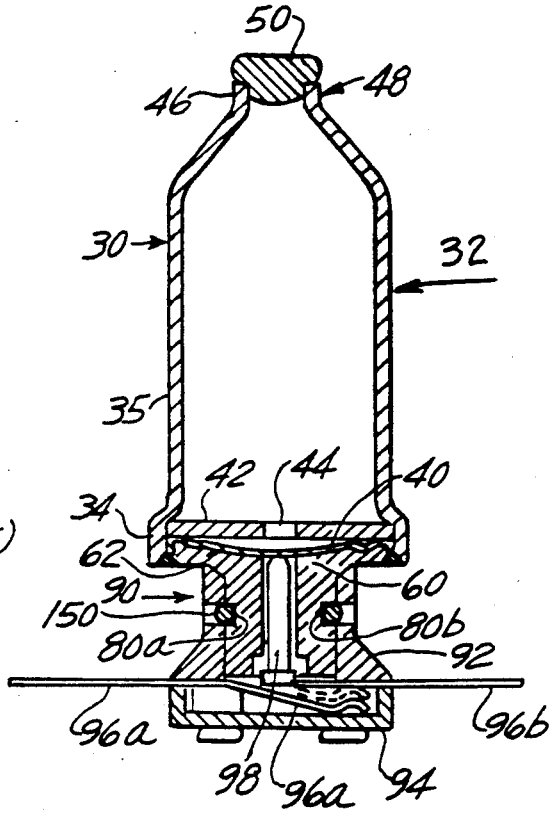
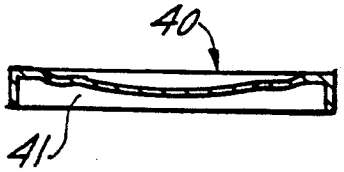
FIG.5

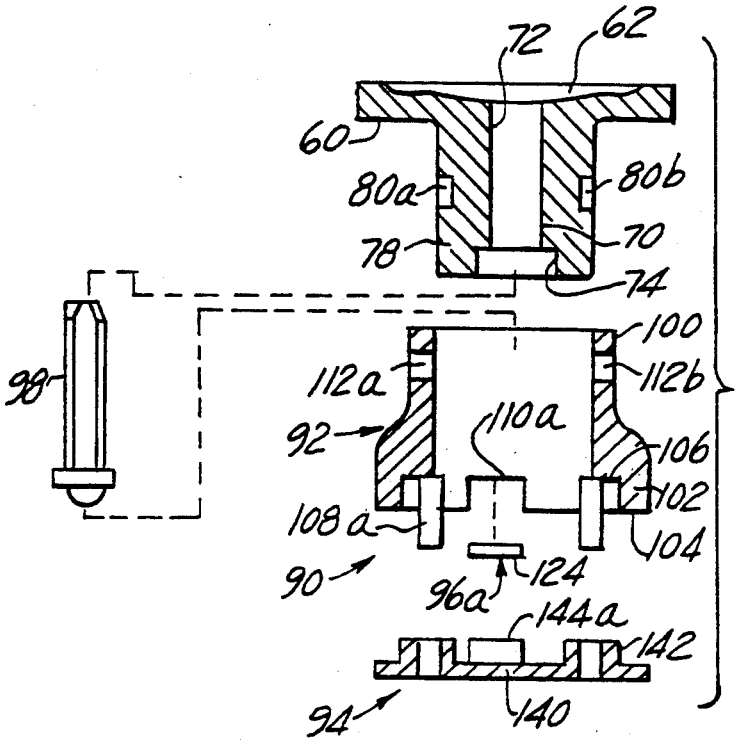
FIG.6
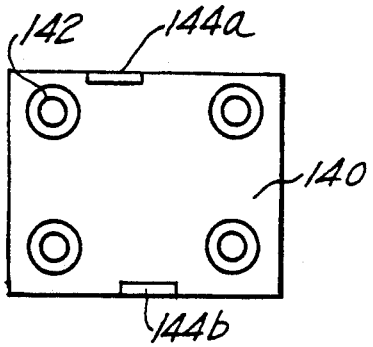
FIG.9
FIG.7
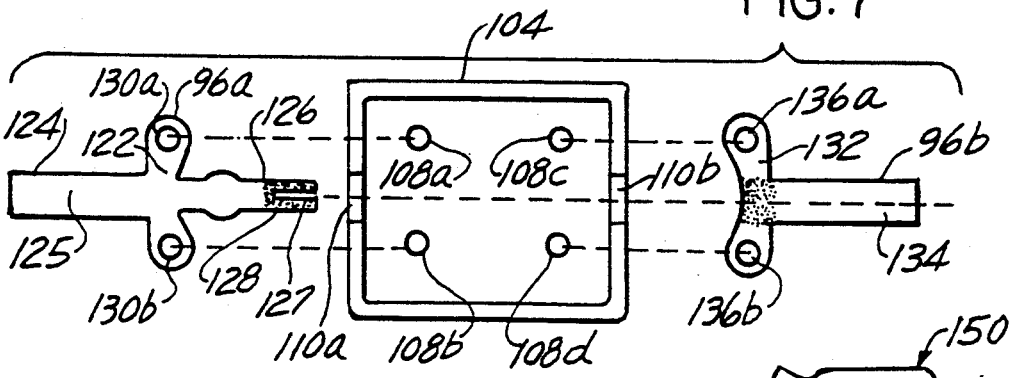
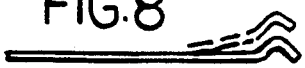
FIG.8
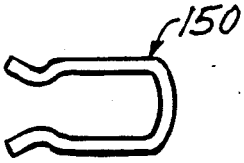
FIG.11

FIG.10
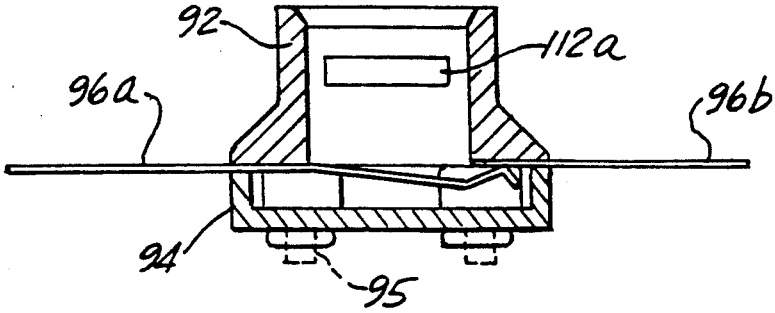
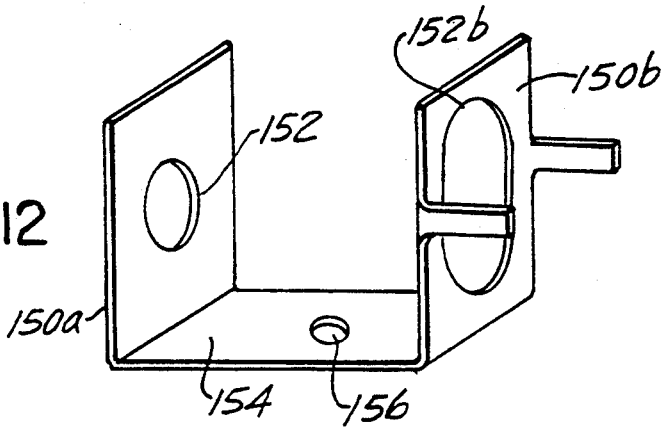
FIG.12
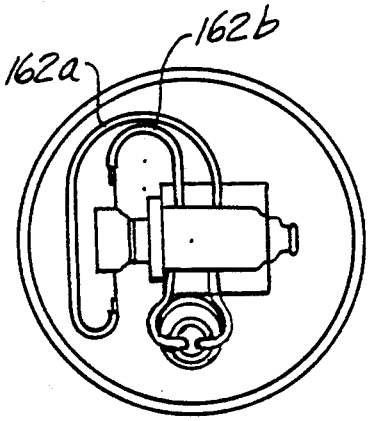
FIG.13
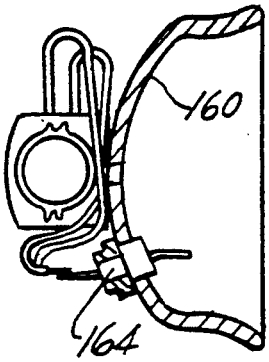
FIG.14
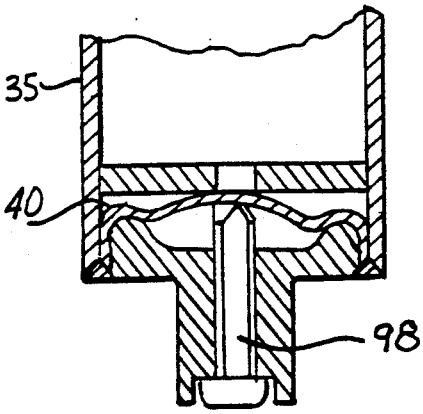
FIG.15

TEMPERATURE COMPENSATED LOW PRESSURE SWITCH FOR HYBRID INFLATORS

BACKGROUND AND SUMMARY OF THE INVENTION

The present invention relates generally to hybrid inflators useful for inflating air bags and more particularly to a switch for sensing a low pressure condition within the hybrid inflator.

U.S. Pat. No. 4,049,935 is illustrative of one type of pressure switch that may be used in combination with the hybrid inflator which is incorporated herein by reference. The switch of U.S. Pat. No. 4,049,935 is shown in FIG. 1 herein and comprises a pressure vessel 1 sealed at an open end by a diaphragm 2, a pair of reinforcement members 3 and 4 to limit the motion of the diaphragm 2. This pressure switch also includes a switch assembly 5 comprising electrical contacts 6 and 7 and a moveable pin 8. The diaphragm 2 is moveable up and down in relation to the pressure differential acting thereacross. As can be appreciated, the inner surface of the diaphragm is exposed to the pressure of the gas within the pressure vessel 1 of the switch and the outer surface of the diaphragm is exposed to the local environment i.e. the pressure within the hybrid inflator 9 which in and of itself comprises a second pressure vessel filled with pressurized inflation gas. The hybrid inflator is used to inflate an air bag mounted in communication therewith in a known manner. The switch assembly 5 is compressively loaded against other portions of the pressure switch during assembly While not shown in FIG. 1, it can be appreciated that if a mounting bracket end loads (see arrows 11) the pressure switch, this compressive loading will be increased. One deficiency of this type of switch is that the reinforcement members could become bowed because of the compressive loading moving the pin 8 and diaphragm somewhat closer to the contact 6. The closer spacing permitted the pin to prematurely engage the contact 6 forcing same against contact 7 giving rise to a false low pressure signal. FIGS. 2 and 3 further explain this bowing movement using a similar switch arrangement. This switch is end loaded by a support bracket (not shown) to mount the pressure vessel 1 inside the hybrid inflator. The support bracket compressively loads the pressure vessel and switch assembly 5 axially as illustrated by arrows 11 as shown in FIG. 2. As mentioned, this compressive loading may tend to cause the switch assembly to bow upwardly (see FIG. 3) lifting the moveable pin 8. This phenomenon does not occur instantaneously and is time and force dependent causing creep of the plastic parts used in the switch assembly. As can be seen in this bowed configuration, the pin 8 resides closer to the electrical contacts than desirable and occasionally the pressure switch may become inadvertently activated, as the electrical contacts became separated, giving a false indication of a low pressure condition in the hybrid inflator pressure vessel when the pressure was not low.

It is an object of the present invention to provide an improved temperature compensated pressure switch.

Accordingly the invention comprises: a pressure switch adapted to be placed within a pressurized chamber for generating a logical signal when the pressure within the chamber reduces to a determinable pressure $P^1$. The pressure switch comprises: a pressure vessel sealed at one end by a snap action diagram and having an an inner stop and an outer stop respectively positioned on opposing sides of the diaphragm for limiting diaphragm motion. The outer stop comprises: a first cylindrical portion, a first pair of parallel slots formed therein and a through bore extending therethrough. A switch assembly is loosely mounted to the outer stop. The switch assembly comprises an upper housing member, a lower housing member, first and second electrical contacts and a pin. The upper housing member comprising a hollow cylindrical portion adapted to be slid over first cylindrical portion including a second pair of opposing slots, the first and second cylindrical portions are loosely secured together by a clip fitted within the first and second pair of slots. The first electrical contact is received through a first one of the notches and secured about some of plurality of pins including a moveable spring portion. The second electrical contact is received through a second one of the notches and secured about others of the plurality pins and spaced from the spring portion. The pin is loosely received through the through bore, the first electrical contact lightly biasing the pin against the diaphragm, the pin moveable in response to the motion of the diaphragm in response to the pressure differential thereacross, the pin urging the first electrical contact away from the second electrical contact in response to the snap action of the diaphragm when a low pressure condition arises in the pressurized chamber.

Many other objects and purposes of the invention will be clear from the following detailed description of the drawings.

BRIEF DESCRIPTION OF THE DRAWINGS

In the drawings:

FIG. 1 illustrates a prior art pressure switch.

FIGS. 2 and 3 illustrate various positions of the prior art pressure switch.

FIG. 4 illustrates a cross-sectional view of a pressure switch or sensor incorporating the present invention.

FIG. 5 illustrates a cross-sectional view of the diaphragm 40.

FIG. 6 illustrates a cross-sectional view of certain major components of the present invention.

FIG. 7 illustrates a partial assembly view of components of the present invention.

FIG. 8 illustrates a view of a spring.

FIG. 9 illustrates a plan view of a lower housing member.

FIG. 10 illustrates the switch assembly.

FIG. 11 illustrates a retaining clip.

FIG. 12 shows a support bracket.

FIGS. 13 and 14 show a switch module installed in a hybrid inflator.

FIG. 15 shows the diaphragm in its normal position.

DETAILED DESCRIPTION OF THE DRAWINGS

FIG. 4 illustrates a low pressure switch 30 comprising a pressure vessel 32 and switch module 90. The pressure vessel is preferably fabricated of steel and includes an open end 34. A flexible diaphragm 40, shown in greater detail in FIG. 5, is sealed to the pressure vessel proximate the open end. The diaphragm 40 is of known construction and is of the "snap action" variety. As is known in the prior art, the diaphragm is preferably heat treated in order to prevent residual stresses from forming. Preferably the diaphragm has a preset convex shape shown in FIG. 5 with a circular convolution placed therein. Returning to FIG. 4, positioned within the pressure vessel is an internal diaphragm support which limits the inward motion of the diaphragm 40. This support comprises a disc 42 preferably welded to the walls of the pressure vessel 32 and includes an opening 44 to permit gas pressure to communicate thereacross. The disc 42 is preferably manufactured of steel. The other end 46 of the pressure vessel is formed as a hollow tubular member 48 enclosed by a seal 50 which may comprise a metal ball welded thereon. Prior to placing the seal 50 on the pressure vessel, a quantity of gas is inserted under pressure within the pressure vessel 32. Typically the gas is pressurized to approximately 2,700 psig (18,717 KPA). The constituency of the gas within the pressure vessel is identical to the gas contained within the hybrid inflator. Typically this gas is Argon with a small amount of helium (approximately 2%) by volume. The helium is useful as a means for detecting leaks. Helium detection mechanisms are available in the art and do not comprise a portion of the present invention.

Situated below or exterior to the diaphragm is an external diaphragm support 60 preferably manufactured of steel which is secured proximate the open end 34 of the pressure vessel 32 such as by welding. As the diaphragm 40 contains an outwardly extending lip 41 (see FIG. 5) which is positioned near the external support the welding procedure simultaneously secures the diaphragm 40 and external support 60 to the pressure vessel 32. As can be see, the external support 60 is spaced from the internal support 42. The spacing defines the range of movement of the diaphragm 40. In addition, the external support 60 comprises a diaphragm support surface 62 (see FIGS. 4 and 6) conformal to the shape of the diaphragm in its rest or outward position. The external support 60 includes a stepped bore 70. The stepped bore 70 comprises a narrow through bore 72, a wider bore 74 and a step 76 therebetween. The narrow bore 72 intersects the support surface 62. Formed on the exterior of a cylindrical portion 78 of the external support 60 are two parallel notches, grooves or slots 80*a* and 80*b* the purpose of which will be clear from the discussion below.

Reference is again made to FIG. 4. The switch assembly 90 comprises an upper housing member 92 and a lower housing member 94, plurality of electrical contacts 96*a* and 96*b* and a pin 98 which is slidably movable within bore 72 . The shaft of the pin 98 has a triangular cross-section to minimize friction in the bore 72. The above components are more clearly shown in FIGS. 6 and 7.

FIG. 6 illustrates a partial assembly view of the switch assembly 90. As can be seen the upper housing member 92 comprises a hollow cylindrical, preferably plastic, portion 100 adapted to be received about the cylindrical part 78 of the external diaphragm support 60. As will be seen from the description below, the interconnection between the switch housing 90 and the diaphragm support 60 is in the manner so as not to introduce stress loading in the switch assembly to eliminate distortion or bowing. The upper housing member 92 includes a webbed portion 102 having a cylindrical wall 104 extending oppositely from the cylindrical portion 100. A bottom surface 106 extends across a portion of the upper housing member 92. Extending from the bottom 106 are four legs or pins 108*a–d* which are arranged in two sets of two pins or legs, i.e. 108*a,b* and 108*c,d*. The wall 104 includes two opposing and slightly offset notches 110*a* and 110*b*. Only one of such notches is shown in FIG. 6 (also see FIG. 7). The upper housing member 92 further includes a set of parallel grooves 112*a* and 112*b* the purpose of which will be apparent from the description below.

Reference is made to FIG. 7 which illustrates a partial assembly view of the upper (switch) housing member and the plurality of contacts 96*a* and 96*b*. As can be seen, the notches 110*a* and 110*b* are slightly offset one to the other so that only a specific one of the contacts can be inserted into a designated notch. Also shown in FIG. 7 are plan views of the two contacts 96*a* and 96*b*. The first contact 96*a* typically constructed of beryllium copper plated with nickel and gold, has a generally T-shaped configuration comprising a crossbar 122 and a leg 124 including leg portions 125 and 126. It should be noted that in contact 96*a*, the leg portion 125 is not symmetric to the axis which runs through leg portion 126. The leg portion 126 is split at 127 to provide redundant contact points which are coated with gold for good long term electrical continuity at a contact patch 128. The gold plating is preferably only in the small contact area for economic reasons. The contact 96*a* which is a resilient spring-like member, comprises the moveable contact of the switch assembly 90. A side view of this contact is shown in FIG. 8. FIG. 8 illustrates the free or unstressed position of the contact in dashed line. FIG. 8 also illustrates the stressed position of the contact 96*a*. As can be seen the contact 96*a* includes a plurality of bends so that it may fit within the upper housing member 92 as well as properly engage the other electrical contact 96*b*. As can be seen from FIG. 4, the spring action of the contact 96*a* urges the pin 98 against the diaphragm. The contact 96*a* further includes a plurality of openings 130*a* and 130*b* within the crossbar 122. During assembly the contact 96*a* is vertically positioned within the housing member 92 using a Z-axis fabrication technique such that the holes 130*a,b* fit over the pins 108*a,b* and the extending leg 124 (or leg portion 125) is received within notch 110*a*. The other electrical contact 96*b* comprises a flat electrical conductor of general T-shape, having a crossbar 132, extending leg 134 and plurality of openings 136*a* and 136*b*. The leg 134 is offset relative to the crossbar 132. During assembly the contact 96*b* is inserted within the housing member 92 such that the pins 108*c,d* are received within the openings 136*a,b* and the leg 134 received within the groove 110*b*.

Reference is again made to FIG. 6. A part of the extending leg 124 of contact 96*a* is shown positioned relative to notch 110*a*. Positioned below the upper housing member 92 is the lower housing member 94. The lower housing member 94 comprises a generally flat base 140 and four upstanding cylindrical portions 142 through which a respective one of the pins 108*d* extend. FIG. 9, shows a plan view of the flat base 140. Extending upwardly from the bottom 140 are two flanges 144*a* and 144*b*, only one of which is illustrated in FIG. 6. As can be seen, upon assembly of the switch assembly 90 the contacts, such as 96*a*, will be fit within a respective notch such as 110*a*, the lower housing member is thereafter slide upon the respective pins 108*d* and the flanges 144*a,b* push the respective contact 96*a* and 96*b* upwardly into the corresponding slot 110*a* and 110*b*. FIG. 10 illustrates an isolated view with the upper and lower housing members joined together such as by welding at 95 and the contacts 96*a* and 96*b* positioned therebetween. The switch assembly 90 is thereafter inserted over the external diaphragm support 60. The upper housing member is pushed onto the support 60 such that the grooves 80*a* and 80*b* are in alignment with the slots or grooves 112*a* and 112*b*. Thereafter a retaining clip 150 shown in plan view in FIG. 11 and in cross-sectional view in FIG. 4 is attached thereto. As can be seen in this configuration, the switch assembly is relatively loosely connected to the external diaphragm support 60 thereby eliminating any stress build-up. As can be seen from above, with the exception of the retaining clip 150 each of the components of the switch assembly 9 can be assembled by using a Z-axis insertion manufacturing technique.

Reference is made to FIG. 12 which illustrates a three-sided bracket for holding the pressure switch 30. The bracket includes two side walls 150*a* and 150*b* and a connecting side 154. Wall 150*a* includes a small opening 152*a* into which is received the tubular end 48 of the pressure vessel. Wall 150*b* includes a larger opening 152*b* through which the long wall 35 of pressure vessel extends. Wall 150*b* includes a plurality of outstanding tabs which are bent and thereafter secured to the wall of the pressure vessel proximate the open end 34. The connecting side 154 comprises an opening 156 for receipt of a fastener which is used to secure the pressure switch to a wall of the hybrid inflator as illustrated in FIG. 14 numeral 160 is indicative of an end wall of a hybrid inflator. FIG. 13 shows various conductive wires 162*a* and 162*b* are welded to the extending portions of the contacts 96*a* and 96*b*. The wires are feed to the exterior of the hybrid inflator through a glass-to-metal sealing bead 164.

The hybrid inflator is normally pressurized with Argon/Helium gas (inflation gas) to the pressure of approximate 3,000 psi (20,785 KPA) which is a pressure slightly higher than the pressure within the pressure vessel 32 of the switch 30. When the gas within the hybrid inflator is within prescribed limits, the diaphragm 40 takes the stressed position shown in FIG. 15. As can be appreciated, the higher pressure inflation gas within the hybrid inflator migrates through the switch assembly 90 as the parts are loose fitting and through the bore 70 urging the diaphragm away from the external support 40 and against the internal support 42. The spring force of the leaf contact 96*a* causes the pin 98 to remain in contact with the diaphragm as the diaphragm moves. This motion allows the contacts 96*a,b* to connect (see the dotted line position of contact 96*a* in FIG. 4). Accordingly, when the inflation pressure is within the above-mentioned prescribed limits the switch assembly is electrically closed. Should the gas within the hybrid inflator leak, the pressure therein will reduce below the prescribed limit. The force acting on the diaphragm 40 from within the switch pressure vessel 32 resulting from the pressured gas therein is now greater than the pressure or force acting on the outer surface of the diaphragm. In this situation the diaphragm snaps downwardly to its natural position thereby causing the switch contacts to open. The benefit of utilizing the snap action type of the diaphragm is that the diaphragm will rapidly move, quickly moving the two contacts 96*a,b* apart. This rapid movement avoids arcing between the contacts. It should be recalled that the nominal pressure in the switch pressure vessel 32 is slightly less than the nominal pressure in the hybrid inflator 9. Consequently, if the switch pressure vessel 32 should leak, the internal pressure within such pressure vessel 32 will increase to the higher pressure level of the gas in the inflator. Under this leak condition the diaphragm would also snap downwardly to its natural position thereby opening the contacts and causing an open circuit.

Any open circuit condition would activate a low pressure indicator or signaling device to generate a diagnostic and/or warning connected in circuit with the contacts 96*a,b* signaling indicating a potential malfunction of the hybrid inflator or pressure switch 30. Further, the hybrid inflator 9 and the pressure vessel 32 are subject to high and low ambient temperatures. The pressure within each will change in accordance with the universal gas law $PV=ZNRT$. As can be appreciated, the pressure differential across the diaphragm will remain relatively constant within a specified range. As such, the pressure switch 30 is accordingly temperature compensated and precludes inappropriate actuation in situations where the inflator pressure may naturally drop below 2,000 psi (13,890 KPA) due to cold ambient temperatures.

Many changes and modifications in the above described embodiment of the invention can, of course, be carried out without departing from the scope thereof. Accordingly, that scope is intended to be limited only by the scope of the appended claims.

We claim:

1. A pressure switch assembly (30) adapted to be placed within a pressurized chamber for generating a logical signal when the pressure within the chamber reduces to a determinable pressure $P_1$, the pressure switch (30) comprising:

a pressure vessel (32) sealed at one end (34) by a snap action diaphragm (40) and filled to a determinable pressure $P_2$ less than the pressure $P_1$ of the pressure chamber;

inner stop means (42) and outer stop means (60, 62) respectively positioned on opposing sides of the diaphragm (40) for limiting diaphragm motion, the inner stop means (42) comprising a flat plate having an opening (44) therethrough;

the outer stop means comprising an arcuate top surface (62) conformed with the shape of the diaphragm when in its outward extending condition, a first cylindrical portion (78) below the top surface (62), a first pair of parallel slots (80*a,b*) formed therein and a through bore (70, 72, 74) extending therethrough;

a switch assembly (90) comprising an upper housing member (92), a lower housing member (94), first and second electrical contacts (96*a*, 96*b*) and an activation pin (98);

the upper housing member (92) comprising a hollow cylindrical portion (100) adapted to be slid over first cylindrical portion (78) including a second pair of opposing slots (112*a,b*), the first and second cylindrical portions (78, 100) are loosely secured together by a clip (150) fitted within the first and second pair of slots (80*a,b*; 112*a,b*), the upper housing member further including opposingly positioned first and second notches (110*a,b*) and two sets of outwardly extending, oppositely positioned locating pins (108*a–d*);

the first electrical contact including a first contact portion and an extending first crossbar having first openings near each end thereof, the first contact portion received through a first one of the notches of the upper housing member and the openings of the first crossbar received about a first set of locating pins;

the second electrical contact (96*b*) including a second contact portion and an extending second crossbar having second openings near each end thereof, the second contact portion received through a second one of the notches (110*a, b*), the second openings received about a second of the sets of locating pins, the second electrical contact spaced from the first electrical contact, the activation pin (98) loosely received through the through bore (70, 72, 74), the first electrical contact (96*a*) lightly biasing the activation pin (98) against the diaphragm (40), the activation pin moveable in response to the motion of the diaphragm (40) in response to the pressure differential thereacross, the activation pin urging the first electrical contact (96*a*) away from closure with the second electrical contact (96*b*) in response to the snap action of the diaphragm (40).

2. The device as defined in claim 1 wherein the first and second notches are off-set one to the other.

3. The device as defined in claim 1 wherein the lower housing member includes a plurality of pin receiving openings for receipt of the first and second set of location pins, and upwardly extending flanges which fit into the first and second notches to pinch the first and second electrical contacts therebetween.

4. The device as defined in claim 2 wherein the openings in first crossbar are off-set relative to first contact portion.

5. The device as defined in claim 2 wherein the openings in second crossbar are off-set relative to second contact portion.

* * * * *